US006213022B1

(12) United States Patent
Pullum

(10) Patent No.: US 6,213,022 B1
(45) Date of Patent: Apr. 10, 2001

(54) CARTRIDGE FOR HUNTING OR THE LIKE

(76) Inventor: Johnie R. Pullum, 730 New Jersey Ave., Brooklyn, NY (US) 11207

( * ) Notice: Subject to any disclaimer, the term of this patent is extended or adjusted under 35 U.S.C. 154(b) by 0 days.

(21) Appl. No.: 09/307,434

(22) Filed: May 10, 1999

(51) Int. Cl.[7] ..... F42B 12/34
(52) U.S. Cl. ..... 102/439; 102/507
(58) Field of Search ..... 102/439, 501, 102/503, 506–511, 514–517, 529

(56) References Cited

U.S. PATENT DOCUMENTS

| | | | | |
|---|---|---|---|---|
| 843,017 | * | 2/1907 | Hoxie | 102/510 |
| 1,073,349 | * | 9/1913 | Hoagland | 102/509 |
| 1,112,413 | * | 9/1914 | Hoagland | 102/507 |
| 3,941,059 | * | 3/1976 | Cobb | 102/510 |
| 4,044,685 | | 8/1977 | Avcin | 102/91 |
| 4,938,147 | | 7/1990 | Czetto, Jr. | 102/507 |
| 5,185,495 | | 2/1993 | Petrovich et al. | 102/510 |
| 5,275,110 | * | 1/1994 | Flatau | 102/509 |
| 5,834,683 | | 11/1998 | Benvegnu' | 102/516 |

FOREIGN PATENT DOCUMENTS

| | | | | |
|---|---|---|---|---|
| 14717 | * | 3/1900 | (GB) | 102/507 |

* cited by examiner

*Primary Examiner*—Harold J. Tudor
(74) *Attorney, Agent, or Firm*—Richard L. Miller, P. E.

(57) ABSTRACT

An improved cartridge of a type having a casing and a bullet with a tip expellable from the casing for entering a target. The improvement includes the bullet having a pair of throughbores bored through different levels thereof for causing the bullet to expand violently and over a wide diameter and mushroom halfway in the target so as to cause severe damage, destruction, and hemorrhage to internal organs of the target for a quick kill, with the mushrooming being regular up to a first throughbore of said pair of throughbores and then splitting causing not only a wider mushroom but a sudden extra shock to the target due to more energy transfer caused by more tissue displacement of the target due to the wider mushroom, and with the bullet then splitting again at a second throughbore of said pair of throughbores so as to further widen the mushroom for even more shock and damage to the internal organs of the target causing a quicker kill by virtue of the bullet expanding and peeling back to nearly inside out.

5 Claims, 1 Drawing Sheet

3,5
13
18
14
20
16
5
5
10,110
4
12

10
13
14
18
16
20

13
122
110
14
18
16
20

10,110
11

13
18
20
14
10,110
14

13
10
18
16
14
20
16

CARTRIDGE FOR HUNTING OR THE LIKE

BACKGROUND OF THE INVENTION

1. Field of the Invention

The present invention relates to a cartridge for hunting or the like. More particularly, the present invention relates to an improved cartridge for hunting or the like.

2. Description of the Prior Art

Numerous innovations for projectiles for hunting or the like have been provided in the prior art that will be described. Even though these innovations may be suitable for the specific individual purposes to which they address, however, they differ from the present invention.

A FIRST EXAMPLE, U.S. Pat. No. 4,044,685 to Avcin teaches a jacketless hunting projectile or bullet of the mushrooming-tip, high cutting-type that has a projectile body including a solid cylindrical guide part and a hollow head tapering toward a point. The hollow head has a progressively increasing wall thickness toward the solid part of the bullet and defines a cylindrical hollow space which receives a filling of a spreading material forming the tip of the projectile. This material rolls back the head after splitting it along notches formed in the hollow wall with sharp edges.

A SECOND EXAMPLE, U.S. Pat. No. 4,938,147 to Czetto, Jr. teaches a collapsible bullet that is provided which rapidly expands upon impact and possesses excellent penetration characteristics. The bullet includes at least two separate parts which form an integrated unit, i.e., a nose part having a central bore therethrough and a base or rear part which includes a central collapse column that projects through the opening in the nose part. The distal end of the collapse column is peened over to help hold the parts together. After initial impact by the leading end of the nose part, successive impacts are produced by the rear part, and any intermediate parts, as these parts are driven into the nose part, thereby causing an outward expansion of the nose part and possible complete penetration of the nose part by the rear part or parts.

A THIRD EXAMPLE, U.S. Pat. No. 5,185,495 to Petrovich et al. teaches an improved partially jacketed projectile intended for small arms use. The projectile includes a central stem integral with a rear wall of the projectile, the rear wall in turn being integral with the partial jacket. A core surrounding the stem and encased by the jacket is softer than the material forming the stem, rear wall and jacket. The jacket retards core petalling during initial projectile impact whereas the rear wall configuration enhances petalling when the projectile achieves subsequent target penetration.

A FOURTH EXAMPLE, U.S. Pat. No. 5,834,683 to Benvegnu' teaches a projectile for firearms that has a body consisting of a plurality of disc-shaped elements coaxially fitted in a holding cup forcedly filled therewith.

It is apparent that numerous innovations for projectiles have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an improved cartridge for hunting and the like that avoids the disadvantages of the prior art.

ANOTHER OBJECT of the present invention is to provide an improved cartridge for hunting and the like that is simple and inexpensive to manufacture.

STILL ANOTHER OBJECT of the present invention is to provide an improved cartridge for hunting and the like that is simple to use.

BRIEFLY STATED, YET ANOTHER OBJECT of the present invention is to provide an improved cartridge of a type having a casing and a bullet with a tip expellable from the casing for entering a target. The improvement includes the bullet having a pair of throughbores bored through different levels thereof for causing the bullet to expand violently and over a wide diameter and mushroom halfway in the target so as to cause severe damage, destruction, and hemorrhage to internal organs of the target for a quick kill, with the mushrooming being regular up to a first throughbore of said pair of throughbores and then splitting causing not only a wider mushroom but a sudden extra shock to the target due to more energy transfer caused by more tissue displacement of the target due to the wider mushroom, and with the bullet then splitting again at a second throughbore of said pair of throughbores so as to further widen the mushroom for even more shock and damage to the internal organs of the target causing a quicker kill by virtue of the bullet expanding and peeling back to nearly inside out.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

First Embodiment

Figures 1, 2, 3, 4, 5, 6, 7:
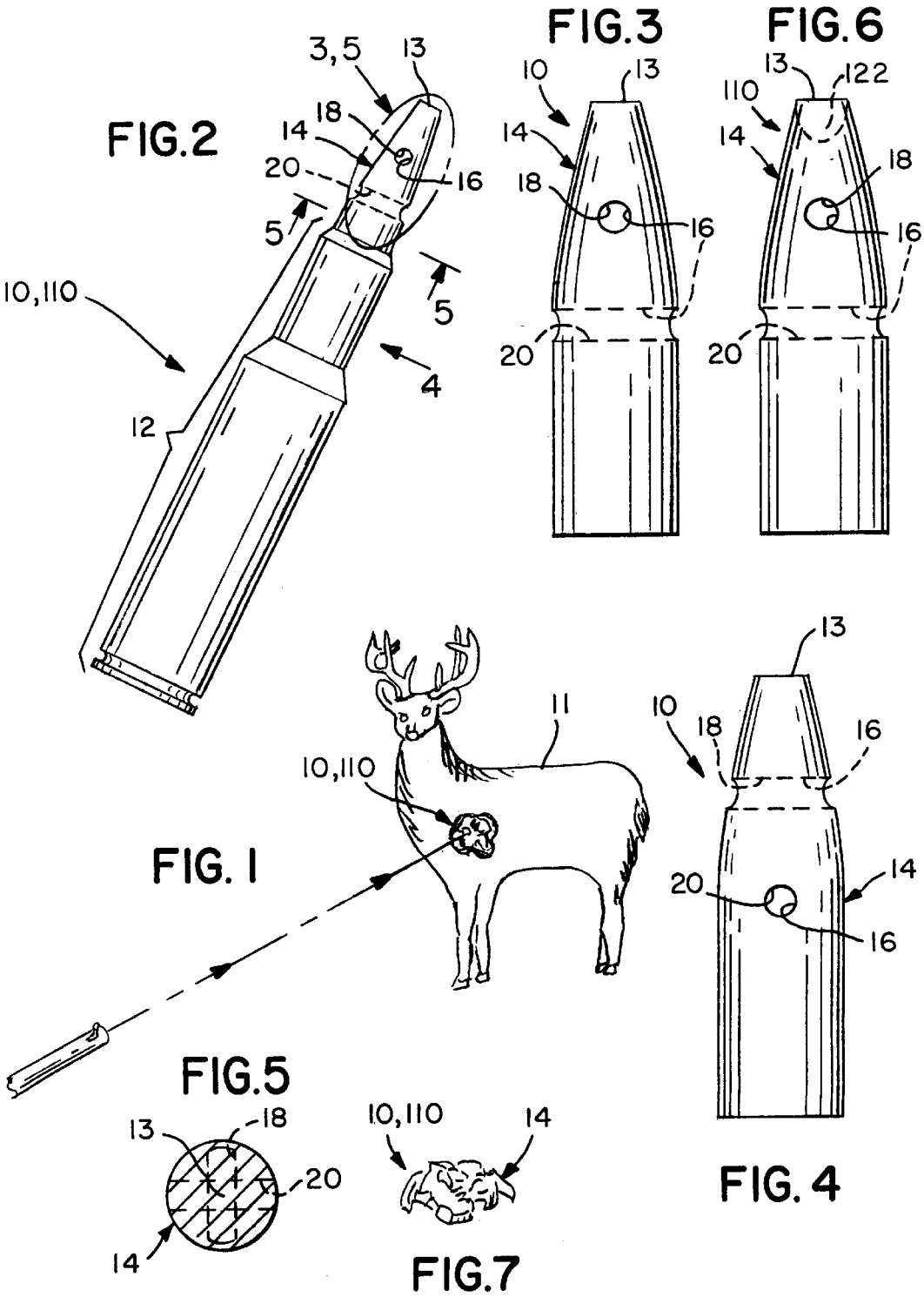
FIG. 1 is a diagrammatic perspective view of the present invention in use.
FIG. 2 is a diagrammatic side elevational view of the present invention.
FIG. 3 is an enlarged diagrammatic side elevational view of the area generally enclosed by the dotted curve identified by arrow 3 in FIG. 2 of a first embodiment of the present invention.
FIG. 4 is a diagrammatic side elevational view taken generally in the direction of arrow 4 in FIG. 2.
FIG. 5 is an sectional view taken along line 5—5 FIG. 2.
FIG. 6 is an enlarged diagrammatic side elevational view of the area generally enclosed by the dotted curve identified by arrow 5 in FIG. 2 of a second embodiment of the present invention.
FIG. 7 is a diagrammatic perspective view of a spent bullet of the present invention.

10 improved cartridge of the present invention
11 target
12 casing
13 tip of bullet 14
14 bullet
16 pair of throughbores bored through different levels of bullet 14 for causing bullet 14 to expand violently and over wide diameter and mushroom halfway in target 11

18 first throughbore of pair of throughbores 16 bored through different levels of bullet 14

20 second throughbore of pair of throughbores 16 bored through different levels of bullet 14

Second Embodiment

110 improved cartridge

122 dimple in tip 13 of bullet 14

DETAILED DESCRIPTION OF THE PREFERRED EMBODIMENT

Referring now to the figures, in which like numerals indicate like parts, and particularly to FIG. 1, a first embodiment of the improved cartridge of the present invention is shown generally at 10 entering a target 11.

The configuration of the improved cartridge 10 can best be seen in FIGS. 1–5 and 7, and as such, will be discussed with reference thereto.

The improved cartridge 10 comprises a casing 12 and a bullet 14 with a tip 13 expellable from the casing 12.

The improvement comprises the bullet 14 having a pair of throughbores 16 bored through different levels thereof for causing the bullet 14 to expand violently and over a wide diameter and mushroom halfway in the target 11 so as to cause severe damage, destruction, and hemorrhage to internal organs of the target 11 for a quick kill, with the mushrooming being regular up to a first throughbore 18 of the pair of throughbores 16 and then splitting causing not only a wider mushroom but a sudden extra shock to the target due to more energy transfer caused by more tissue displacement of the target 11 due to the wider mushroom, and with the bullet 14 then splitting again at a second throughbore 20 of the pair of throughbores 16 so as to further widen the mushroom for even more shock and damage to the internal organs of the target 11 causing a quicker kill by virtue of the bullet 14 expanding and peeling back to nearly inside out.

The improvement further comprises the bullet 14 being soft lead for facilitating the bullet 14 to violently mushroom halfway in the target 11.

The improvement further comprises the bullet 14 being hollow for facilitating the bullet 14 to expand faster and more violently and over a wider diameter and mushroom halfway in the target 11, as shown in FIG. 6.

The improvement further comprises the first throughbore 18 in the bullet 14 being laterally disposed therethrough, in close proximity to the tip 13 of the bullet 14.

The improvement further comprises the second throughbore 20 in the bullet 14 being laterally disposed therethrough, below, separate from, and perpendicular to, the first throughbore 18 in the bullet 14, between the first throughbore 18 in the bullet 14 and the bottom of the bullet.

The configuration of a second embodiment of the improved cartridge 110 can best be seen in FIG. 6, and as such, will be discussed with reference thereto.

The improved cartridge 110 is identical to the improved cartridge 10, with the addition of a dimple 122 in the tip 13 of the bullet 14.

It will be understood that each of the elements described above, or two or more together, may also find a useful application in other types of constructions differing from the types described above.

While the invention has been illustrated and described as embodied in an improved cartridge for hunting and the like, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved cartridge having a casing and a bullet with a tip expellable from the casing for entering a target, wherein the improvement comprises the bullet having a pair of throughbores bored through different areas thereof for causing the bullet to expand violently and over a wide diameter and mushroom halfway in the target so as to cause severe damage, destruction, and hemorrhage to internal organs of the target for a quick kill, with the mushrooming being regular up to a first throughbore of said pair of throughbores and then splitting causing not only a wider mushroom but a sudden extra shock to the target due to more energy transfer caused by more tissue displacement of the target due to the wider mushroom, and with the bullet then splitting again at a second throughbore of said pair of throughbores so as to further widen the mushroom for even more shock and damage to the internal organs of the target causing a quicker kill by virtue of the bullet expanding and peeling back to nearly inside out; said second throughbore in the bullet being laterally disposed therethrough, below, separate and non-connected from, and perpendicular to, said first throughbore in the bullet, between said first throughbore in the bullet and a bottom of the bullet.

2. The improved cartridge as defined in claim 1, wherein the improvement further comprises the bullet being soft lead for facilitating the bullet to violently mushroom halfway in the target.

3. The improved cartridge as defined in claim 1, wherein the improvement further comprises the bullet being hollow or facilitating the bullet to expand faster and more violently and over a wider diameter and mushroom halfway in the target.

4. The improved cartridge as defined in claim 1, wherein the improvement further comprises said first throughbore in the bullet being laterally disposed therethrough, in close proximity to the tip of the bullet.

5. The improved cartridge as defined in claim 1, wherein the improvement further comprises the tip of the bullet having a dimple therein.

* * * * *